US012611590B1

(12) United States Patent
Nash

(10) Patent No.: US 12,611,590 B1
(45) Date of Patent: Apr. 28, 2026

(54) MODIFIED CHESS GAME

(71) Applicant: Marcus Nash, Norwood, PA (US)

(72) Inventor: Marcus Nash, Norwood, PA (US)

( * ) Notice: Subject to any disclaimer, the term of this patent is extended or adjusted under 35 U.S.C. 154(b) by 437 days.

(21) Appl. No.: 18/488,158

(22) Filed: Oct. 17, 2023

(51) Int. Cl.
*A63F 3/02* (2006.01)

(52) U.S. Cl.
CPC ..... *A63F 3/02* (2013.01)

(58) Field of Classification Search
CPC ..... A63F 3/02
See application file for complete search history.

(56) References Cited

U.S. PATENT DOCUMENTS

| | | | | |
|---|---|---|---|---|
| 7,549,931 | B1 | 6/2009 | Faulk | |
| D609,755 | S | 2/2010 | Jones | |
| D695,353 | S | 12/2013 | Taylor | |
| 9,895,600 | B2 | 2/2018 | Johnson | |
| 10,179,274 | B2 | 1/2019 | Louie | |
| D887,494 | S | 6/2020 | Hsu | |
| 10,874,935 | B1 | 12/2020 | Shaw | |
| 11,305,178 | B2 | 4/2022 | Hench | |
| 2025/0099843 | A1* | 3/2025 | Young | A63F 3/00895 |

FOREIGN PATENT DOCUMENTS

| | | | |
|---|---|---|---|
| CA | 2874464 | 11/2013 | |
| CA | 2874464 A1 * | 11/2013 | A63F 3/02 |

* cited by examiner

*Primary Examiner* — Brian O Peters
(74) *Attorney, Agent, or Firm* — Kyle A. Fletcher, Esq.

(57) ABSTRACT

The modified chess game is configured for use with a two-player strategic board game. The modified chess game identifies game tokens that are subsequently exchanged between players during the course of play of the strategic board game. The modified chess game forms a blind that allows each player to make a series of holds for the chosen private token identities. The modified chess game includes a board structure, a plurality of game tokens, a plurality of flag structures, a plurality of card pedestals, a privacy barrier, and a plurality of card panels. The plurality of game tokens are placed on the board structure. The plurality of flag structures, the plurality of card panels, and the plurality of card pedestals are used to identify the individual game tokens that are exchanged between the players.

14 Claims, 4 Drawing Sheets

MODIFIED CHESS GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of board games similar to chess. (A63F3/02)

SUMMARY OF INVENTION

The modified chess game is a kit. The modified chess game is configured for use with a two-player strategic board game. The modified chess game identifies game tokens that are subsequently exchanged between players during the course of play of the strategic board game. The modified chess game forms a blind that allows each player to make a series of holds for private token identities chosen. The playing player is able to review their chosen private token identities without the tokens being immediately visible to the non-playing players or, reveal a chosen private token identity to non-playing players. The modified chess game comprises a board structure, a plurality of game tokens, a plurality of flag structures, a plurality of card pedestals, a privacy barrier, and a plurality of card panels. The plurality of game tokens are placed on the board structure. The plurality of flag structures, the plurality of card panels, and the plurality of card pedestals are used to identify the individual game tokens that are exchanged between the players. The privacy barrier is the physical structure that forms the blind for the chosen private token identities for each player.

These together with additional objects, features and advantages of the modified chess game will be readily apparent to those of ordinary skill in the art upon reading the following detailed description of the presently preferred, but nonetheless illustrative, embodiments when taken in conjunction with the accompanying drawings.

In this respect, before explaining the current embodiments of the modified chess game in detail, it is to be understood that the modified chess game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modified chess game.

It is therefore important that the claims be regarded as including such equivalent construction insofar as they do not depart from the spirit and scope of the modified chess game. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
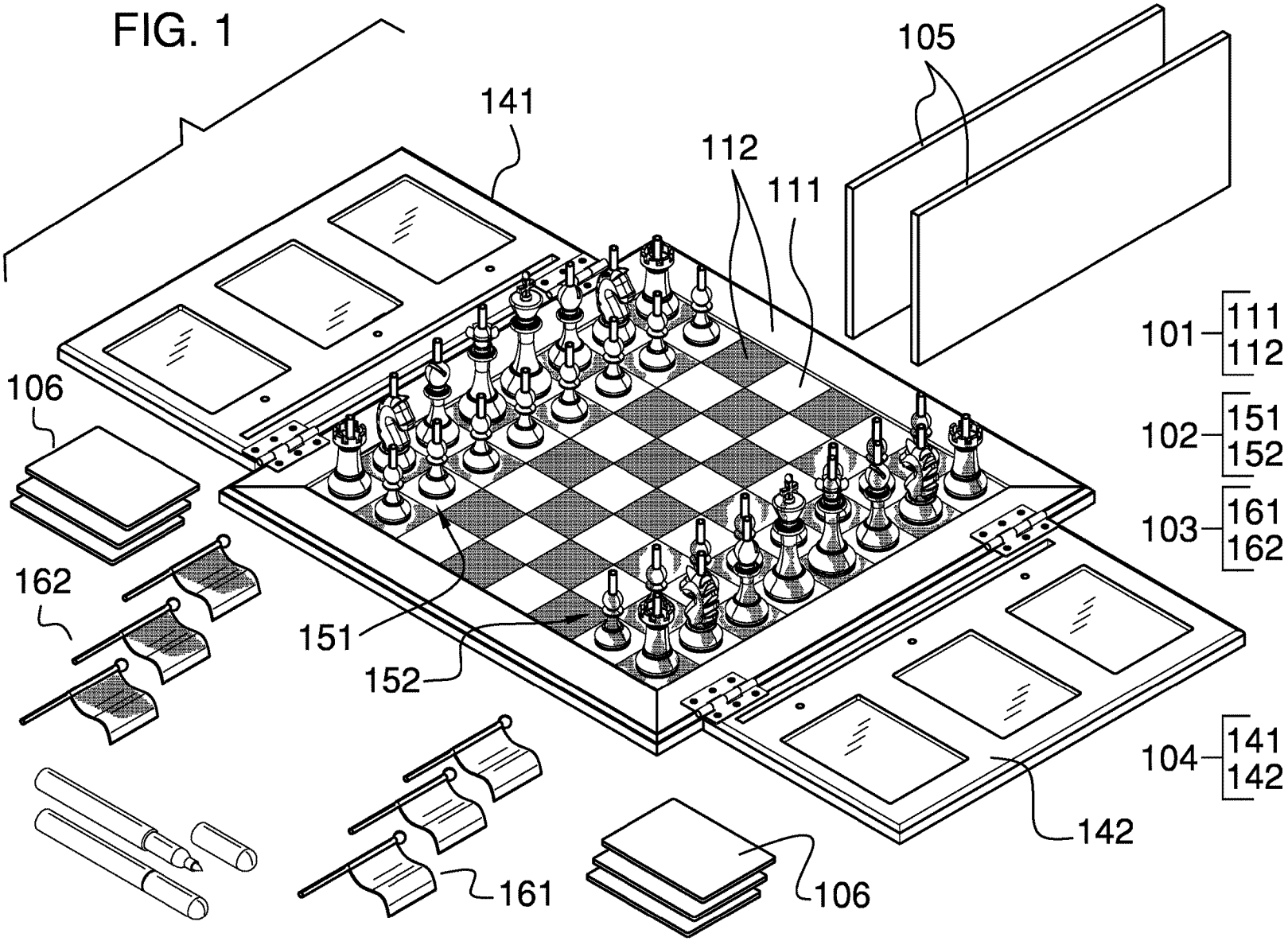
FIG. 1 is a perspective view of an embodiment of the disclosure.
Figure 2:
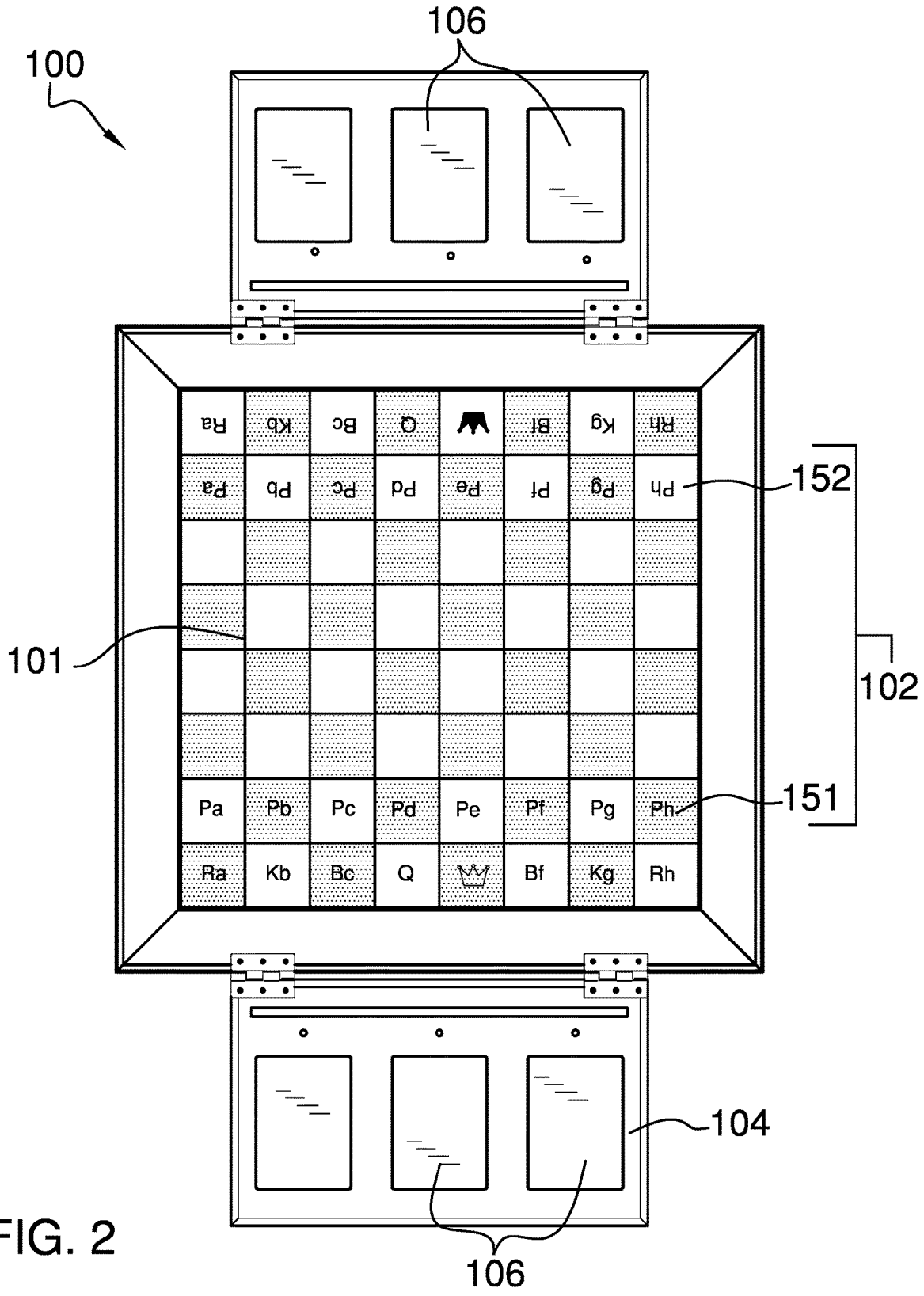
FIG. 2 is a top view of an embodiment of the disclosure.
Figure 3:
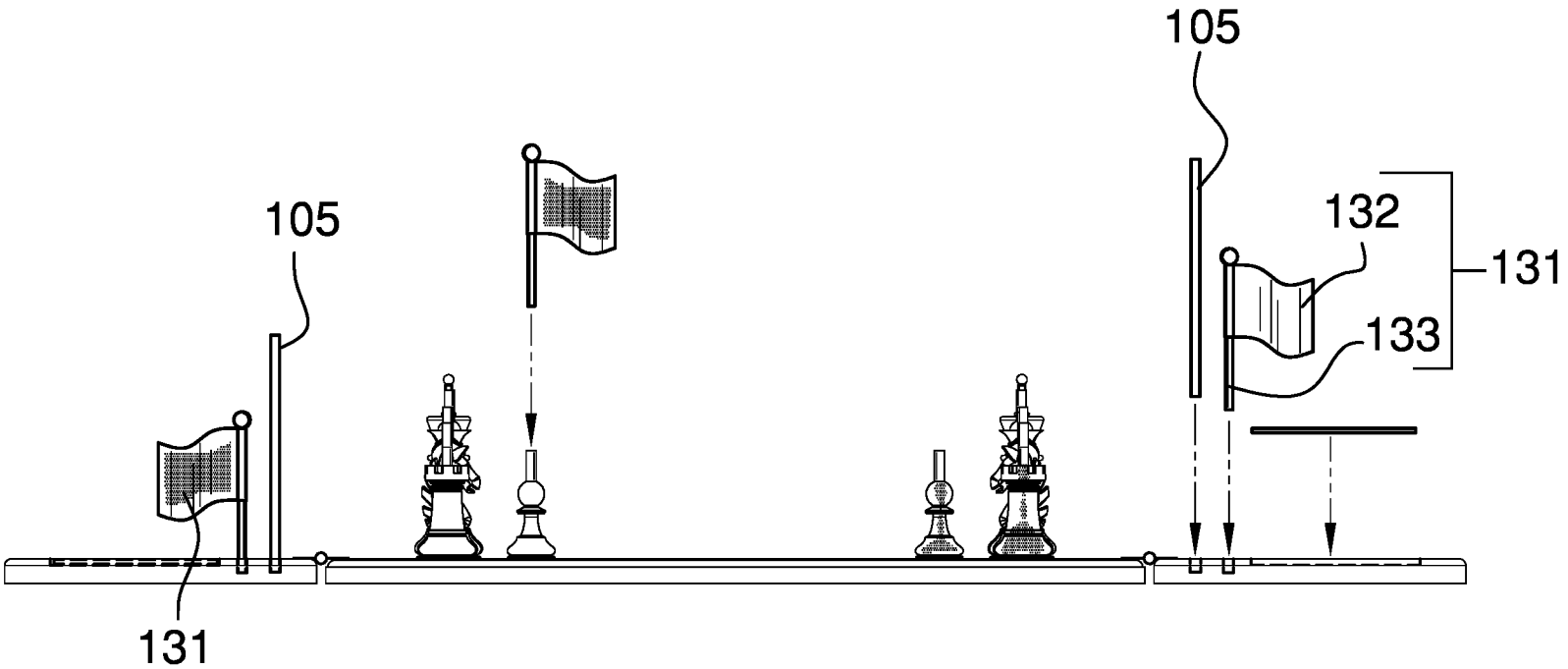
FIG. 3 is a side view of an embodiment of the disclosure.
Figure 4:
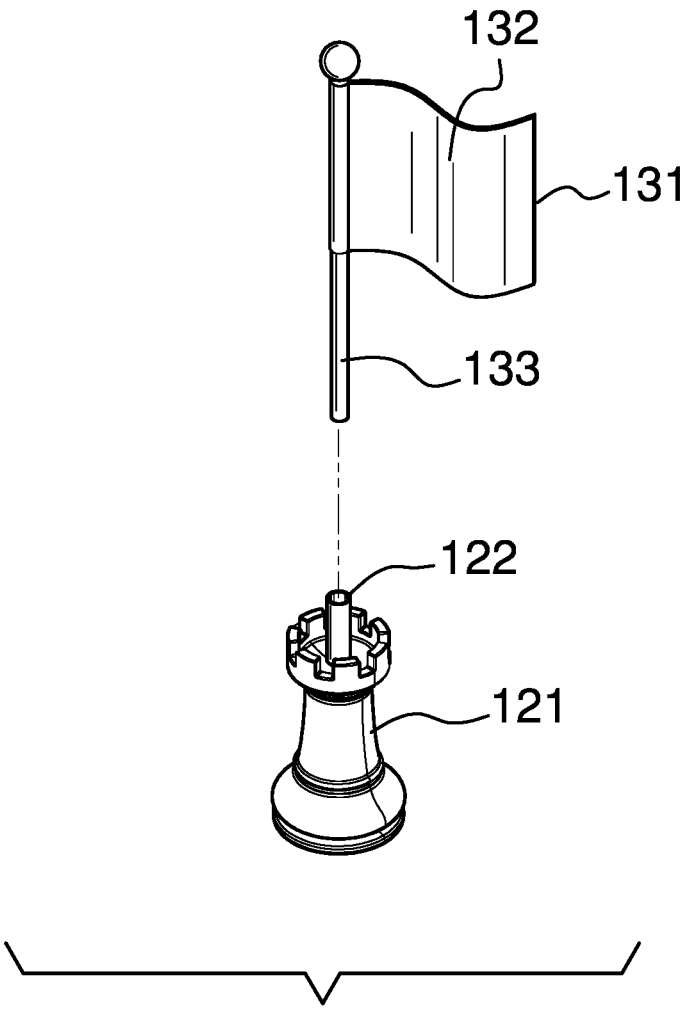
FIG. 4 is a detail view of an embodiment of the disclosure.
Figure 5:
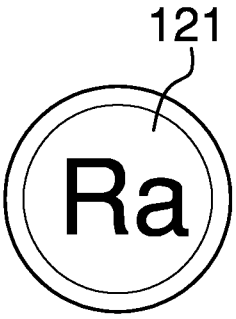
FIG. 5 is a detail view of an embodiment of the disclosure.

Detailed reference will now be made to one or more potential embodiments of the disclosure, which are illustrated in FIGS. 1 through 5.

The modified chess game 100 (hereinafter invention) is a kit. The invention 100 is configured for use with a two-player strategic board game. The invention 100 identifies game tokens that are subsequently exchanged between players during the course of play of the strategic board game. The invention 100 forms a blind that allows each player to make a series of holds of the chosen private token identities. The playing player is able to review their chosen private token identities without the tokens being immediately visible to the non-playing players or reveal a chosen private token identity to non-playing players.

The invention 100 comprises a board structure 101, a plurality of game tokens 102, a plurality of flag structures 103, a plurality of card pedestals 104, a privacy barrier 105, and a plurality of card panels 106. The plurality of game tokens 102 are placed on the board structure 101. The plurality of flag structures 103, the plurality of card panels 106, and the plurality of card pedestals 104 are used to identify the individual game tokens that are exchanged between the players. The privacy barrier 105 is the physical structure that forms the blind for the chosen private token identities for each player.

The board structure 101 forms the playing board of the strategic board game. The board structure 101 is a planar surface. The board structure 101 is formed with an image that defines a plurality of regions. The plurality of game tokens are positioned on the board structure 101. The privacy barrier 105 partially blocks the visibility of the board structure 101 for each competitor.

The board structure 101 comprises a grid pattern 111 and an alternating color pattern 112. The grid pattern 111 is an image of a grid that is formed on the playing surface formed by the board structure 101. The grid pattern 111 displays a plurality of regions that are defined through the rules of the strategic board game. In the first potential embodiment of the disclosure, the grid pattern 111 is formed as an image of the square shaped boundary subdivided into 64 smaller squares. The alternating color pattern 112 is formed from two colors that are distributed such that the any perimeter edge that separates two squares selected from the 64 squares are of different colors. The plurality of game tokens 102 comprises set of individual game tokens 121 that are placed on the board. Each individual game token 121 selected from the plurality of game tokens 102 is distinguishable. The individual game token 121 selected from the plurality of game tokens 102 are not unique. The allowable movement of any individual game token 121 selected from the plurality of game tokens 102 are defined by the rules of the strategic board game. The interactions between the plurality of game tokens 102 are defined by the rules of the strategic board game.

The plurality of game tokens 102 comprises a collection of individual game tokens 121. Each individual game token 121 selected from the plurality of game tokens 102 is a puppet. Each selected individual game token 121 is a marker that is placed on the board structure 101. The starting position of each selected individual game token 121 is defined in the rules of the strategic board game. During each turn, a subset of individual game tokens 121 selected from the plurality of game tokens 102 are moved. The allowable movements of each individual game token 121 selected from the plurality of game tokens 102 is defined in the rules of the strategic board game.

Each individual game token 121 selected from the plurality of game tokens 102 further comprises a mortise structure 122. The mortise structure 122 is a negative space that is formed in the puppet structure of each individual game token 121 selected from the plurality of game tokens 102. The mortise structure 122 forms an anchor point. Each individual flag structure 131 selected from the plurality of flag structures 103 anchors to any individual game token 121 selected from the plurality of game tokens 102 using the mortise structure 122.

The plurality of game tokens 102 further comprises a first subplurality of game tokens 151 and a second subplurality of game tokens 152.

The first subplurality of game tokens 151 is a first subset of individual game tokens 121 selected from the plurality of game tokens 102. The first subplurality of game tokens 151 forms the set of individual game tokens 121 that are assigned under the rules of the strategic board game to the first competitor. Each game token selected from the first subplurality of game tokens 151 is assigned a first color. The color of each game token selected from the first subplurality of game tokens 151 is identical. The second subplurality of game tokens 152 is a second subset of individual game tokens 121 selected from the plurality of game tokens 102.

The second subplurality of game tokens 152 forms the set of individual game tokens 121 that are assigned under the rules of the strategic board game to the second competitor. Each game token selected from the second subplurality of game tokens 152 is assigned a second color. The color of each game token selected from the second subplurality of game tokens 152 is identical. The assigned second color of the second subplurality of game tokens 152 is visibly distinct from the assigned first color of the first subplurality of game tokens 151. The second subplurality of game tokens 152 selected from the plurality of game tokens 102 is therefore visually distinguishable from the first subplurality of game tokens 151 selected from the plurality of game tokens 102.

The privacy barrier 105 is an opaque barrier structure. The privacy barrier 105 is positioned on the board structure 101 such that the visibility of the board structure 101 is partially blocked by the privacy barrier 105. The use of the privacy 21 barrier 105 is defined in the rules of the strategic board game.

The plurality of flag structures 103 forms a marking 23 structure that identifies the individual game tokens 121 that have been designated by the rules to be exchanged between the players under the rules of the strategic board game. The plurality of flag structures 103 comprises a collection of individual flag structures 131.

Each individual flag structure 131 selected from the plurality of flag structures 103 physically attaches to the designated individual game token 121 selected from the plurality of game tokens 102 that is associated with the selected individual game token 121. Each selected individual flag structure 131 removably attaches to any individual game token 121 selected from the plurality of game tokens 102. Each selected individual flag structure 131 removably attaches to the associated selected individual game token 121. Each selected individual flag structure 131 identifies its associated selected individual game token 121 as being designated for exchange.

Each selected individual flag structure 131 is an identification device. Each selected individual flag structure attaches to an individual game token 121 selected from the plurality of game tokens 102. Each selected individual flag structure 131 indicates that the attached individual game token 121 is identified for exchange between competitors in accordance with the rules of the strategic board game. Each individual flag structure 131 selected from the plurality of flag structures 103 further comprises a flag banner 132 and a flag tenon 133.

The flag banner 132 is the banner of the flag structure of the individual flag structure 131. The flag banner 132 identifies that the attached individual game token 121 is identified for exchange between competitors in accordance with the rules of the strategic board game. The flag banner 132 further identifies when the attached individual game token 121 should be exchanged in accordance with the rules of the strategic board game.

The flag banner 132 attaches to the flag tenon 133. The flag tenon 133 is a flag pole. The flag tenon 133 is a prism shaped structure. The flag tenon 133 is a rigid structure. The flag tenon 133 attaches to the associated selected individual game token 121 by inserting into the mortise structure 122. The flag tenon 133 inserts into the mortise structure 122 of the selected individual game token 121 with a tight fit.

The plurality of flag structures 103 further comprises a first subplurality of flag structures 161 and a second subplurality of flag structures 162.

The first subplurality of flag structures 161 is a first subset of individual flag structures 131 selected from the plurality of flag structures 103. The first subplurality of flag structures 161 forms the set of individual flag structures 131 that are assigned under the rules of the strategic board game to the first competitor. Each flag structure selected from the first subplurality of flag structures 161 inserts into an individual game token 121 selected from the plurality of game tokens 102 selected from the second subplurality of game tokens 152 in accordance with the rules of the strategic board game.

The second subplurality of flag structures 162 is a second subset of individual flag structures 131 selected from the plurality of flag structures 103. The second subplurality of flag structures 162 forms the set of individual flag structures 131 that are assigned under the rules of the strategic board game to the second competitor. Each flag structure selected from the second subplurality of flag structures 162 inserts into an individual game token 121 selected from the plurality of game tokens 102 selected from the first subplurality of game tokens 151 in accordance with the rules of the strategic board game.

The plurality of card panels 106 is a display surface. The plurality of card panels 106 mount on the plurality of card pedestals 104. Each card panel selected from the plurality of card panels 106 displays documents information relevant to the exchange of individual game tokens 121 selected from the plurality of game tokens 102. The information displayed on the plurality of card panels 106 is defined in the rules of the strategic board game.

Each card pedestal selected from the plurality of card pedestals 104 is a pedestal. Each competitor in the strategic board game receives a card pedestal selected from the plurality of card pedestals 104. Each card pedestal selected from the plurality of card pedestals 104 visibly displays one or more card panels selected from the plurality of card panels 106. The plurality of card pedestals 104 are used to communicate information between the competitors. The plurality of card pedestals 104 comprises a first card pedestal 141 and a second card pedestal 142.

The first card pedestal 141 is a card pedestal selected from the plurality of card pedestals 104. The first card pedestal 141 is assigned to a first competitor. The first card pedestal 141 is used by the first competitor to visibly display one or more card panels selected from the plurality of card panels 106. The information conveyed by the one or more selected card panels is defined by the rules of the strategic board game.

The second card pedestal 142 is a pedestal selected from the plurality of card pedestals 104. The second card pedestal 142 is assigned to a second competitor. The second card pedestal 142 is used by the second competitor to visibly display one or more card panels selected from the plurality of card panels 106. The information conveyed by the one or more selected card panels is defined by the rules of the strategic board game.

The following definitions were used in this disclosure:

Barrier: As used in this disclosure, a barrier is a physical obstacle that forms a boundary between a first space and a second space. The barrier prevents the passage of an object between the first space and the second space.

Blind: As used in this disclosure, a blind is a structure that is used to conceal a person or an object.

Board Game: As used in this disclosure, a board game is a game that incorporates a board into the rules of the game. A board is a planar surface that is subdivided into a plurality of regions. The position of each player within the plurality of regions is identified using a token. A linear path board game describes a board game wherein the token of any player moves through the plurality of regions in a fixed sequence in a forward and backward direction. A strategic board game describes a board game where: a) the players take turns sequentially; b) each player manages one or more tokens placed one the board; c) allowable token movements do not follow a linear path but instead are defined within the rules of the strategic board game; and, d) interactions between tokens are defined within the rules of the strategic board game. Chess and checkers are examples of a strategic board game. A two-person strategic board game is a strategic board game that is played between two competitors.

Card: As used in this disclosure, a card means a flat stiff piece of material that bears information. Typical materials used to make cards include, but are not limited to, heavy paper, cardboard, plastic coated paper, or thin plastic. While this disclosure allows for variations in the size of a card, it is anticipated that cards will approximate the size of a traditional deck of playing cards. The sides of the card that bear the information are called faces.

Competitor: As used in this disclosure, a competitor is a person who is participating in a competitive activity such as a sporting event or a game.

Distinguishable and Unique: As used in this disclosure, the terms distinguishable and unique are applied to objects contained in a plurality of objects. An object selected from the plurality of objects is referred to as distinguishable if the selected object has a characteristic that allows the selected object to be differentiated from at least one unselected object remaining in the plurality of objects. A first object selected from the plurality of objects is referred to as unique if the selected object has a characteristic that allows the selected object to be differentiated from any second object selected from the plurality of objects. The term indistinguishable indicates that the objects contained in the plurality of objects are neither distinguishable nor unique.

Flag: As used in this disclosure, a flag is a textile or sheeting material that is attached by one edge to a pole or a rope. In general usage, a flag will display an image that often contains some form of symbolic meaning or message. This definition maps to the common patent classification definitions and is therefore explicitly intended to include flag like objects commonly referred to as a "banner".

Flag Pole: As used in this disclosure, a flag pole is a shaft to which a flag is attached.

Game: As used in this disclosure, a game is a competition between two or more players wherein each of the two or more players attempt to outperform the other players according to a previously determined set of rules. The winner of the game is traditionally rewarded with social or economic benefits. The primary purpose of a game is often to provide entertainment.

Game of Skill: As used in this disclosure, a game of skill is a competition wherein the outcome of the competition will at least partially depend upon the skill of a player.

Grid: As used in this disclosure, a grid is a network of intersecting parallel and perpendicular lines. The rectangular space within a grid that is bounded by two adjacent parallel lines and two adjacent parallel lines is called a cell. A dot grid pattern refers to a grid that is represented by an image that displays only the points of intersection formed at the intersection of each parallel and perpendicular line that forms the grid.

Kit: As used in this disclosure, a kit is an assembly of a combination of instruments, equipment, or supplies that are dedicated or intended for use in a specific purpose. Depending on the context, a kit may further include the container within which the instruments, equipment, and supplies are stored.

Mortise: As used in this disclosure, a mortise is a negative space formed in a material that is designed to receive a similarly shaped object such that the similarly shaped object is flush to the interior surfaces of the formed by the mortise. Frictional forces between the mortise and the tenon are often used to secure the tenon within the mortise.

Private: As used in this disclosure, the term private refers to the limitation of use of an object to one or more individuals. The term privacy refers to maintaining an object or individual in a location where the object or individual can be neither observed nor disturbed.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Puppet: As used in this disclosure, a puppet is a FIG. resembling a human, animal or symbolic image that can be moved and that is used for entertainment or educational purposes. Puppets are often used as tokens within a board game.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Token: As used in this disclosure, a token is a marker used to identify the location of a player on the board of a board based game.

Turn: As used in this disclosure, a turn refers to one or more predetermined actions taken by a competitor in a game. Whiteboard: As used in this disclosure, a whiteboard is a surface that is designed to receive non-permanent markings that can be used for communication or recordation purposes. This definition is explicitly intended to include chalkboards. Whiteboards are also commonly referred to as dry erase boards.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modified chess game comprising a plurality of game tokens, a plurality of flag structures, a plurality of card pedestals, a privacy barrier, and a plurality of card panels;

wherein the plurality of game tokens, the plurality of flag structures, the plurality of card pedestals, the privacy barrier, and the plurality of card panels are combined to form a kit.

2. The modified chess game according to claim 1 wherein the modified chess game is configured for use with a two-player strategic board game;

wherein the modified chess game identifies game tokens that are subsequently exchanged between players during the course of play of the strategic board game;

wherein the modified chess game forms a blind for chosen private token identities for each player.

3. The modified chess game according to claim 2 wherein the plurality of game tokens are placed on the board structure;

wherein the plurality of flag structures, the plurality of card panels, and the plurality of card pedestals are used to identify the individual game tokens that are exchanged between the players;

wherein the privacy barrier is the physical structure that forms the blind for the chosen private identities for each player.

4. The modified chess game according to claim 3 wherein the board structure forms the playing board of the strategic board game;

wherein the board structure is a planar surface;

wherein the board structure is formed with an image that defines a plurality of regions;

wherein the plurality of game tokens are positioned on the board structure;

wherein the privacy barrier partially blocks the visibility of the board structure;

wherein the board structure comprises a grid pattern and an alternating color pattern;

wherein the grid pattern is an image of a grid that is formed on the playing surface formed by the board structure;

wherein the grid pattern displays a plurality of regions that are defined through the rules of the strategic board game;

wherein the alternating color pattern is formed from two colors that are distributed such that the any perimeter edge that separates two squares selected from the 64 squares are of different colors.

5. The modified chess game according to claim 4 wherein the plurality of game tokens comprises set of individual game tokens that are placed on the board;

wherein each individual game token selected from the plurality of game tokens is distinguishable;

wherein the individual game token selected from the plurality of game tokens are not unique;

wherein the allowable movement of any individual game token selected from the plurality of game tokens are defined by the rules of the strategic board game;

wherein the interactions between the plurality of game tokens are defined by the rules of the strategic board game.

6. The modified chess game according to claim 5 wherein the privacy barrier is an opaque barrier structure;

wherein the privacy barrier is positioned on the board structure such that the visibility of the board structure is partially blocked by the privacy barrier;

wherein the use of the privacy barrier is defined in the rules of the strategic board game;

wherein the plurality of flag structures forms a marking structure that identifies the individual game tokens that have been designated by the rules to be exchanged between the players under the rules of the strategic board game.

7. The modified chess game according to claim 6
wherein the plurality of flag structures comprises a collection of individual flag structures;
wherein each individual flag structure selected from the plurality of flag structures physically attaches to the designated individual game token selected from the plurality of game tokens that is associated with the selected individual game token;
wherein each selected individual flag structure removably attaches to any individual game token selected from the plurality of game tokens;
wherein each selected individual flag structure removably attaches to the associated selected individual game token;
wherein each selected individual flag structure identifies its associated selected individual game token as being designated for exchange;
wherein each selected individual flag structure is an identification device;
wherein each selected individual flag structure attaches to an individual game token selected from the plurality of game tokens;
wherein each selected individual flag structure indicates that the attached individual game token is identified for exchange between competitors in accordance with the rules of the strategic board game.

8. The modified chess game according to claim 7
wherein the plurality of card panels form display surfaces;
wherein the plurality of card panels mount on the plurality of card pedestals;
wherein each card panel selected from the plurality of card panels displays documents information relevant to the exchange of individual game tokens selected from the plurality of game tokens;
wherein the information displayed on the plurality of card panels is defined in the rules of the strategic board game.

9. The modified chess game according to claim 8
wherein each card pedestal selected from the plurality of card pedestals is a pedestal;
wherein each competitor in the strategic board game receives a card pedestal selected from the plurality of card pedestals;
wherein each card pedestal selected from the plurality of card pedestals visibly displays one or more card panels selected from the plurality of card panels;
wherein the plurality of card pedestals are used to communicate information between the competitors.

10. The modified chess game according to claim 9
wherein the plurality of game tokens comprises a collection of individual game tokens;
wherein each individual game token selected from the plurality of game tokens is a puppet;
wherein each selected individual game token is a marker that is placed on the board structure;
wherein the starting position of each selected individual game token is defined in the rules of the strategic board game;
wherein during each turn, a subset of individual game tokens selected from the plurality of game tokens are moved;
wherein the allowable movements of each individual game token selected from the plurality of game tokens is defined in the rules of the strategic board game;
wherein each individual game token selected from the plurality of game tokens further comprises a mortise structure;
wherein the mortise structure is a negative space that is formed in the puppet structure of each individual game token selected from the plurality of game tokens;
wherein the mortise structure forms an anchor point;
wherein each individual flag structure selected from the plurality of flag structures anchors to any individual game token selected from the plurality of game tokens using the mortise structure.

11. The modified chess game according to claim 3
wherein each individual flag structure selected from the plurality of flag structures further comprises a flag banner and a flag tenon;
wherein the flag banner is the banner of the flag structure of the individual flag structure;
wherein the flag banner identifies that the attached individual game token is identified for exchange between competitors in accordance with the rules of the strategic board game;
wherein the flag banner further identifies when the attached individual game token should be exchanged in accordance with the rules of the strategic board game;
wherein the flag banner attaches to the flag tenon;
wherein the flag tenon is a flag pole;
wherein the flag tenon is a prism shaped structure;
wherein the flag tenon is a rigid structure;
wherein the flag tenon attaches to the associated selected individual game token by inserting into the mortise structure;
wherein the flag tenon inserts into the mortise structure of the selected individual game token with a tight fit.

12. The modified chess game according to claim 11
wherein the plurality of game tokens further comprises a first subplurality of game tokens and a second subplurality of game tokens;
wherein the first subplurality of game tokens is a first subset of individual game tokens selected from the plurality of game tokens;
wherein the first subplurality of game tokens forms the set of individual game tokens that are assigned under the rules of the strategic board game to the first competitor;
wherein each game token selected from the first subplurality of game tokens is assigned a first color;
wherein the color of each game token selected from the first subplurality of game tokens is identical;
wherein the second subplurality of game tokens is a second subset of individual game tokens selected from the plurality of game tokens;
wherein the second subplurality of game tokens forms the set of individual game tokens that are assigned under the rules of the strategic board game to the second competitor;
wherein each game token selected from the second subplurality of game tokens is assigned a second color;
wherein the color of each game token selected from the second subplurality of game tokens is identical;
wherein the assigned second color of the second subplurality of game tokens is visibly distinct from the assigned first color of the first subplurality of game tokens;
wherein the second subplurality of game tokens selected from the plurality of game tokens is therefore visually distinguishable from the first subplurality of game tokens selected from the plurality of game tokens.

13. The modified chess game according to claim 12
wherein the plurality of flag structures further comprises a first subplurality of flag structures and a second subplurality of flag structures;

wherein the first subplurality of flag structures is a first subset of individual flag structures selected from the plurality of flag structures;

wherein the first subplurality of flag structures forms the set of individual flag structures that are assigned under the rules of the strategic board game to the first competitor;

wherein each flag structure selected from the first subplurality of flag structures inserts into an individual game token selected from the plurality of game tokens selected from the second subplurality of game tokens in accordance with the rules of the strategic board game;

wherein the second subplurality of flag structures is a second subset of individual flag structures selected from the plurality of flag structures;

wherein the second subplurality of flag structures forms the set of individual flag structures that are assigned under the rules of the strategic board game to the second competitor;

wherein each flag structure selected from the second subplurality of flag structures inserts into an individual game token selected from the plurality of game tokens selected from the first subplurality of game tokens in accordance with the rules of the strategic board game.

14. The modified chess game according to claim 13 wherein the plurality of card pedestals comprises a first card pedestal and a second card pedestal;

wherein the first card pedestal is a card pedestal selected from the plurality of card pedestals;

wherein the first card pedestal is assigned to a first competitor;

wherein the first card pedestal is used by the first competitor to visibly display one or more card panels selected from the plurality of card panels;

wherein the information conveyed by the one or more selected card panels is defined by the rules of the strategic board game;

wherein the second card pedestal is a pedestal selected from the plurality of card pedestals;

wherein the second card pedestal is assigned to a second competitor;

wherein the second card pedestal is used by the second competitor to visibly display one or more card panels selected from the plurality of card panels;

wherein the information conveyed by the one or more selected card panels is defined by the rules of the strategic board game.

* * * * *